US007661546B2

(12) United States Patent
Jiang

(10) Patent No.: US 7,661,546 B2
(45) Date of Patent: Feb. 16, 2010

(54) SWITCH CAP FOR DRINKING BOTTLE

(76) Inventor: Yi Xin Jiang, XixXin Plastic Industrial Co., Ltd., Xinsha Industrial Zone, Sha Tou, Chang An Town, Dong Guang City, Guang Dong (CN) 523863

( * ) Notice: Subject to any disclaimer, the term of this patent is extended or adjusted under 35 U.S.C. 154(b) by 360 days.

(21) Appl. No.: 11/247,781

(22) Filed: Oct. 11, 2005

(65) Prior Publication Data

US 2006/0081552 A1 Apr. 20, 2006

(30) Foreign Application Priority Data

Oct. 8, 2004 (CN) ..... 2004 1 00517283

(51) Int. Cl.
*A61J 11/02* (2006.01)
*A61J 11/04* (2006.01)

(52) U.S. Cl. ..... 215/11.1; 215/11.5; 215/11.6; 215/388; 220/707

(58) Field of Classification Search ..... 215/11.6, 215/11.1, 11.5, 237, 229, 388; 220/259.1, 220/707
See application file for complete search history.

(56) References Cited

U.S. PATENT DOCUMENTS 2,996,207 A * 8/1961 Witz ..... 215/11.1
3,232,466 A * 2/1966 Turanciol ..... 215/11.5
4,505,398 A * 3/1985 Kesselring ..... 215/11.5
4,878,898 A * 11/1989 Griffin et al. ..... 604/96.01
5,024,341 A * 6/1991 Dekerle ..... 215/11.1
5,246,145 A * 9/1993 Leoncavallo et al. ... 222/153.14
5,320,232 A * 6/1994 Maguire et al. ..... 215/245
5,419,445 A * 5/1995 Kaesemeyer ..... 215/11.1
5,573,507 A * 11/1996 Moser et al. ..... 604/77
5,653,353 A * 8/1997 Otto et al. ..... 215/306
5,688,238 A * 11/1997 Moser et al. ..... 604/77
5,817,066 A * 10/1998 Goforth ..... 604/212
D414,873 S * 10/1999 Kwiecinski ..... D24/197
6,119,891 A * 9/2000 Favre ..... 220/811
6,196,413 B1 * 3/2001 Tung ..... 220/709
6,415,937 B1 * 7/2002 DeJong et al. ..... 215/386
6,609,624 B2 * 8/2003 Goto et al. ..... 220/259.1
6,644,487 B2 * 11/2003 Smith et al. ..... 215/235
6,851,565 B2 * 2/2005 Stephan ..... 215/389
6,981,607 B2 * 1/2006 Lown et al. ..... 220/254.3
2006/0151420 A1 * 7/2006 Espenschied ..... 215/276

* cited by examiner

*Primary Examiner*—Sue A Weaver
(74) *Attorney, Agent, or Firm*—Global IP Services; Tianhua Gu

(57) ABSTRACT

A switch cap for drinking bottle of the invention includes a rotatable cap; a sucker received inside the rotatable cap; a cap cover covering the rotatable cap; and a switch portion; wherein the rotatable cap is rotatably connected with a circled round mouth the drinking bottle by the switch portion.

5 Claims, 8 Drawing Sheets

SWITCH CAP FOR DRINKING BOTTLE

CROSS REFERENCE TO RELATED APPLICATION

This application claims the benefit of a Chinese patent application Filing No.: CN2004100517283, filed on Oct. 8, 2004.

FIELD OF THE INVENTION

The present invention relates to a switch cap for drinking bottle which can trans-connect with drinking bottle of different caliber, more particularly to that can connect turncap with nipple or nipple to drinking or mineral-water bottle.

BACKGROUND OF THE INVENTION

At present, there are no switch caps for drinking bottle so as to switch the drinking bottle mouth formerly unsuitable for baby, adult to a suitable nipple for them.

Hence, it is desired to provide a switch cap for drinking bottle to solve the above-mentioned problem.

SUMMARY OF THE INVENTION

To overcome the above drawbacks of prior art, a main object of the present invention is to provide a switch cap for drinking bottle which can switch an unsuitable mouth of the drinking bottle formerly for people's drinking to a suitable nipple for drinking.

To attain the above object, a switch cap for drinking bottle, of the present invention comprises a rotatable cap; a nipple received inside the rotatable cap; a cap cover covering the rotatable cap; and a adapter portion; wherein the rotatable cap is rotatably connected with a circled round mouth the drinking bottle by the adapter portion. In the present invention, the adapter portion comprises a cap body, an inner screw thread provided on an inner wall of the cap body; an outside screw thread provided on an outer wall of the cap body; and a plurality of slippery-proof concave grooves provided on the outside circle of bottom of the cap body; the cap body has a top portion, a bottom portion which has a larger diameter than the top portion, and a plat shoulder formed in the middle thereof.

In a first embodiment, the relatable cap comprises an annular wall arranged on a top thereof, and an inner cap screw thread formed corresponding to the outside screw thread and engaged with the outside screw thread; the annular wall extends toward its center and is provided for receiving and positioning the nipple. In another embodiment, the rotatable cap comprises a cap body, an annular wall arranged on a top thereof; an inner cap screw thread formed corresponding to the outside screw thread and engaged with the outside screw thread; a lock means on a side of the cap body, and a non-close protrusion on a top end of the cap body; the annular wall extends toward its center and is provided for receiving and positioning the nipple.

In an embodiment, a hinge means is formed on the bottom of the cap cover, which comprises two symmetrical suspension arms in its two ends and a rotation shaft disposed between and integrally formed with the two suspension arms. The lock means of the cap body comprises a detaining groove in the middle thereof for detaining the rotation shaft; and when the rotation shaft is detained in the detaining groove, the suspension arms of the hinge means will just be locked on the two sides of the lock means; the non-close protrusion extends upwardly along an outer edge of the annular wall. The nipple comprises a sucking part concave inwardly from a head of the nipple, and a positioning pipe; the positioning pipe comprises a drinking straw extending downwardly from a bottom of the nipple. In an embodiment, a ventilate groove is provided on a hemisphere bottom of the nipple.

Comparing to the prior art, the switch cap of the present invention can switch a mouth of a drinking bottle formerly unsuitable for drinking to a suitable nipple for drinking. The design of the switch cap thereby enlarges an application scope of various drinking bottle and is suitable for people of various age. In addition, the switch cap is made of harmless and nonpoisonous materials up to the standards of FDA of USA and EN71 of EU. Furthermore, a design for human makes the switch cap of the present invention safe, sanitary, leak proof, reasonable, convenient for taking and washing and can be used repeatedly.

For the purpose of making the invention easier to understand, several particular embodiments thereof will now be described with reference to the appended drawings.

DETAILED DESCRIPTION OF THE INVENTION

Figure 5:
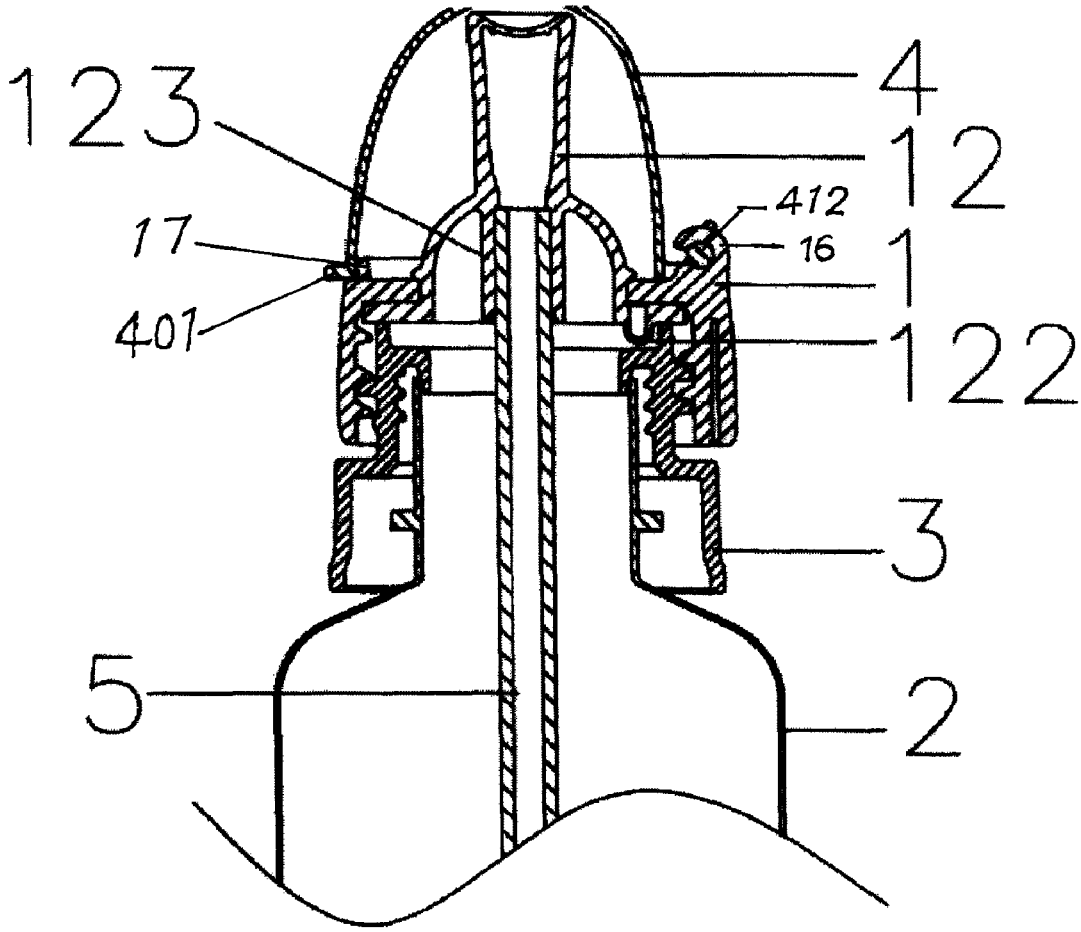
FIG. 5 is a partial, cross-sectional view of the adapter portion of FIG. 4.

Referring to FIG. 5 a switch cap for drinking bottle comprising: a rotatable cap 1; a nipple 12 received inside the rotatable cap 1; a cap cover 4 covering the rotatable cap 1; an adapter portion 3, wherein the rotatable cap 1 is connected with a circled round mouth of the drinking bottle 2 by the adapter portion 3; a lock means including a transverse detaining groove 16 on a side of the rotatable cap (FIG. 14), a non-close protrusion 17 on a top end of the rotatable cap (FIG. 14), a hinge means 41 formed on the bottom of the cap cover 4 having a rotation shaft 412 (FIG. 16), a bulge 401 formed at the side of the cap cover 4 opposite to the detaining groove 16, the rotation shaft being disposed in the detaining groove (FIG. 5), thereby the cap cover 4 can be pivoted to open or close around the rotation shaft 412, when closed the cap cover 4 engages with the non-close protrusion 17 to lock the cap cover 4 with the rotatable cap 1, the locked cap cover 4 can be opened easily by using thumb to push the bulge 401; and the nipple 12 having a receiving hole 123 for receiving a drinking straw 5, which is inserted therein easily.

Referring to the drawings in detail, FIGS. 1-3, 6-13 show a switch cap for drinking bottle according to a first embodiment of the invention. The switch cap for drinking bottle comprises a rotatable cap 1, a nipple 12 received inside the rotatable cap 1, a cap cover 4 covering the rotatable cap 1, and an adapter portion 3. The rotatable cap 1 is rotatably connected with a circled head portion 21 of a drinking bottle 2 by the adapter portion 3. The adapter portion 3 comprises a cap body 32, an inner screw thread 33 provided on an inner wall of the cap body 32; an outside screw thread 34 provided on an outer wall of the cap body 32; and a plurality of slippery-proof concave grooves 35 provided on the outside circle of bottom of the cap body 32. In the invention, the switch cap is made of harmless and nonpoisonous materials.

Figure 1:
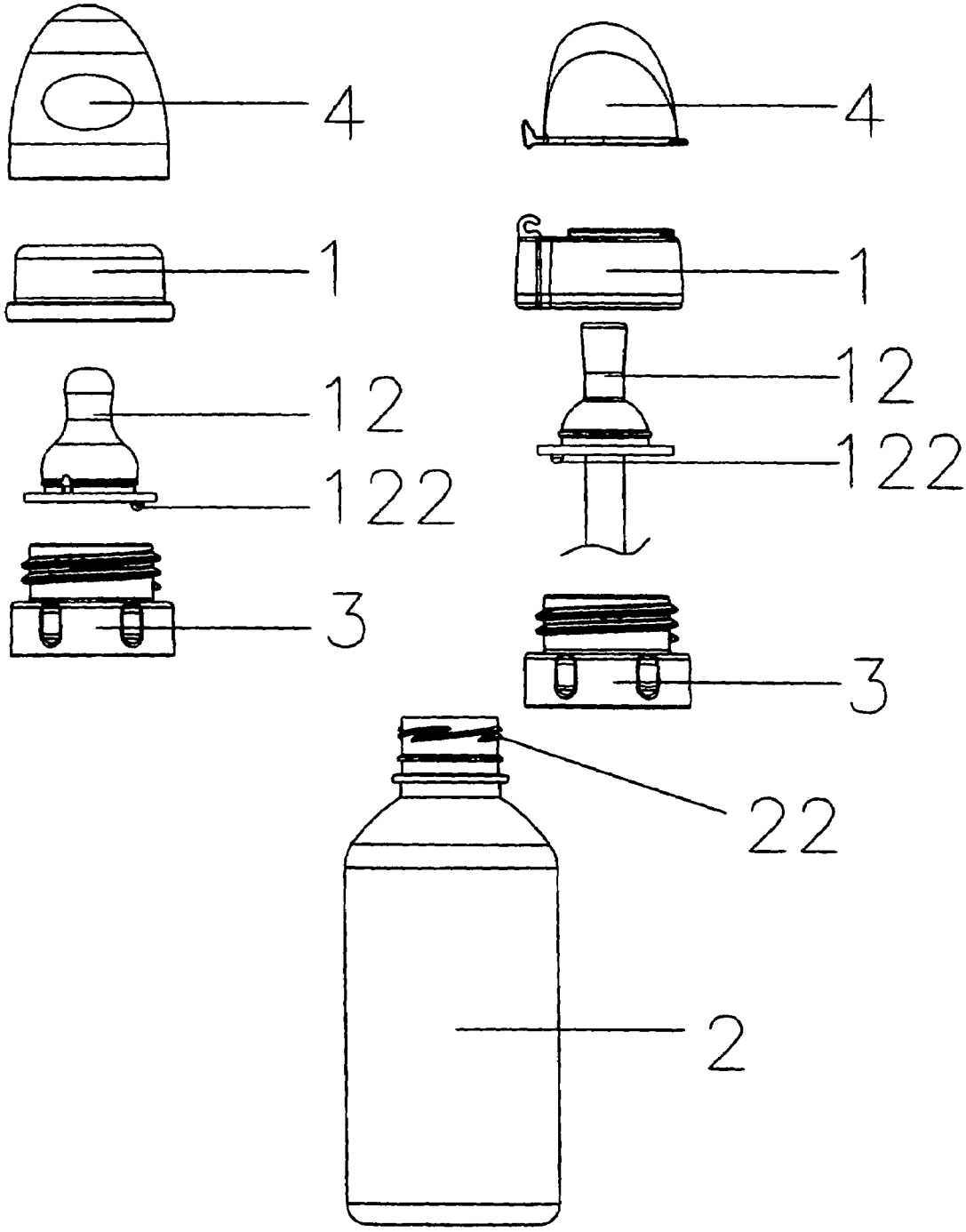
FIG. 1 is an assembly view of a switch cap for drinking bottle of the invention.
Figure 2:
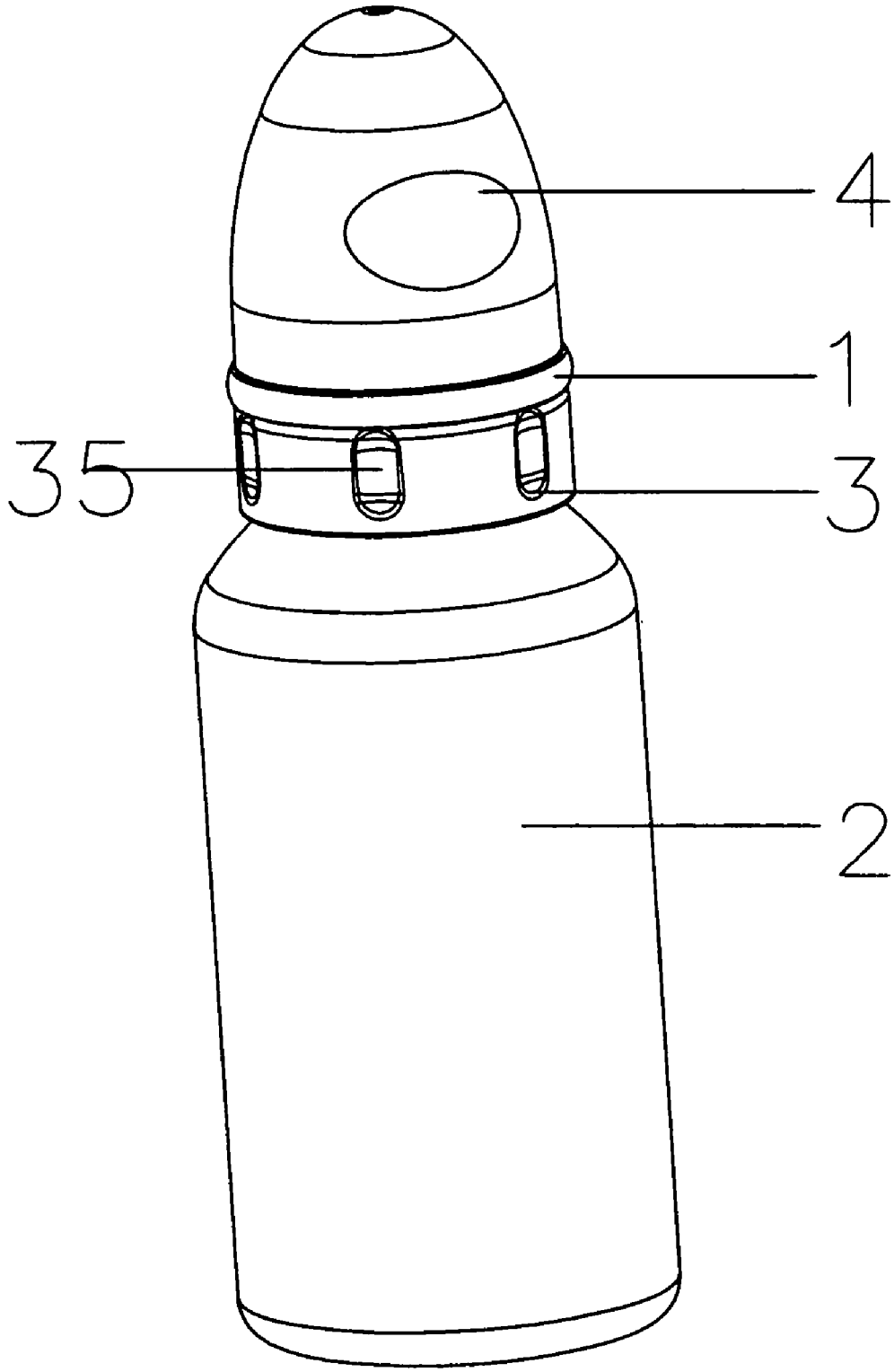
FIG. 2 is a schematic view of an adapter portion of the switch cap according to a first embodiment of the invention.
Figure 3:
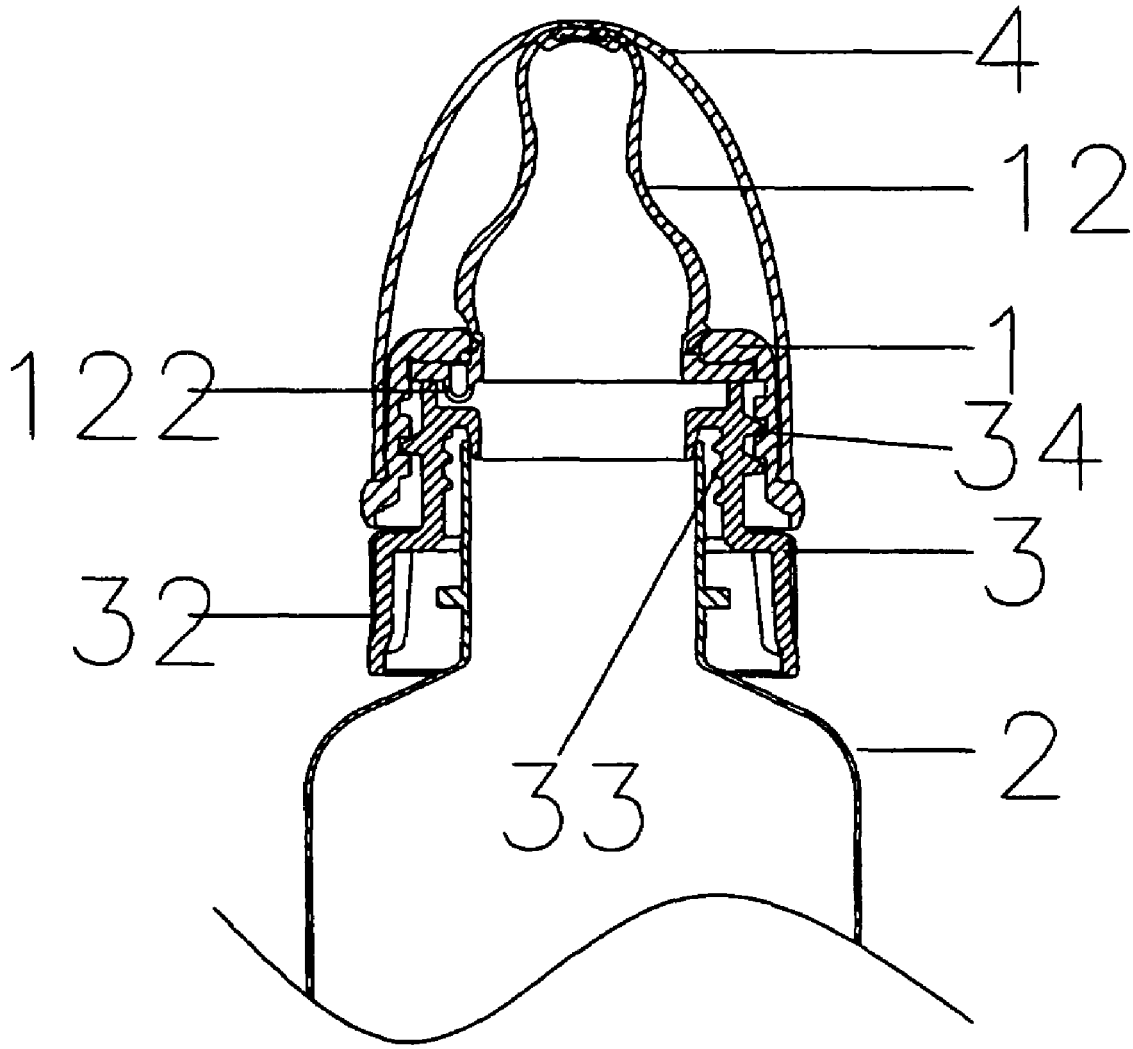
FIG. 3 is a partial, cross-sectional view of the adapter portion of FIG. 2.
Figure 4:
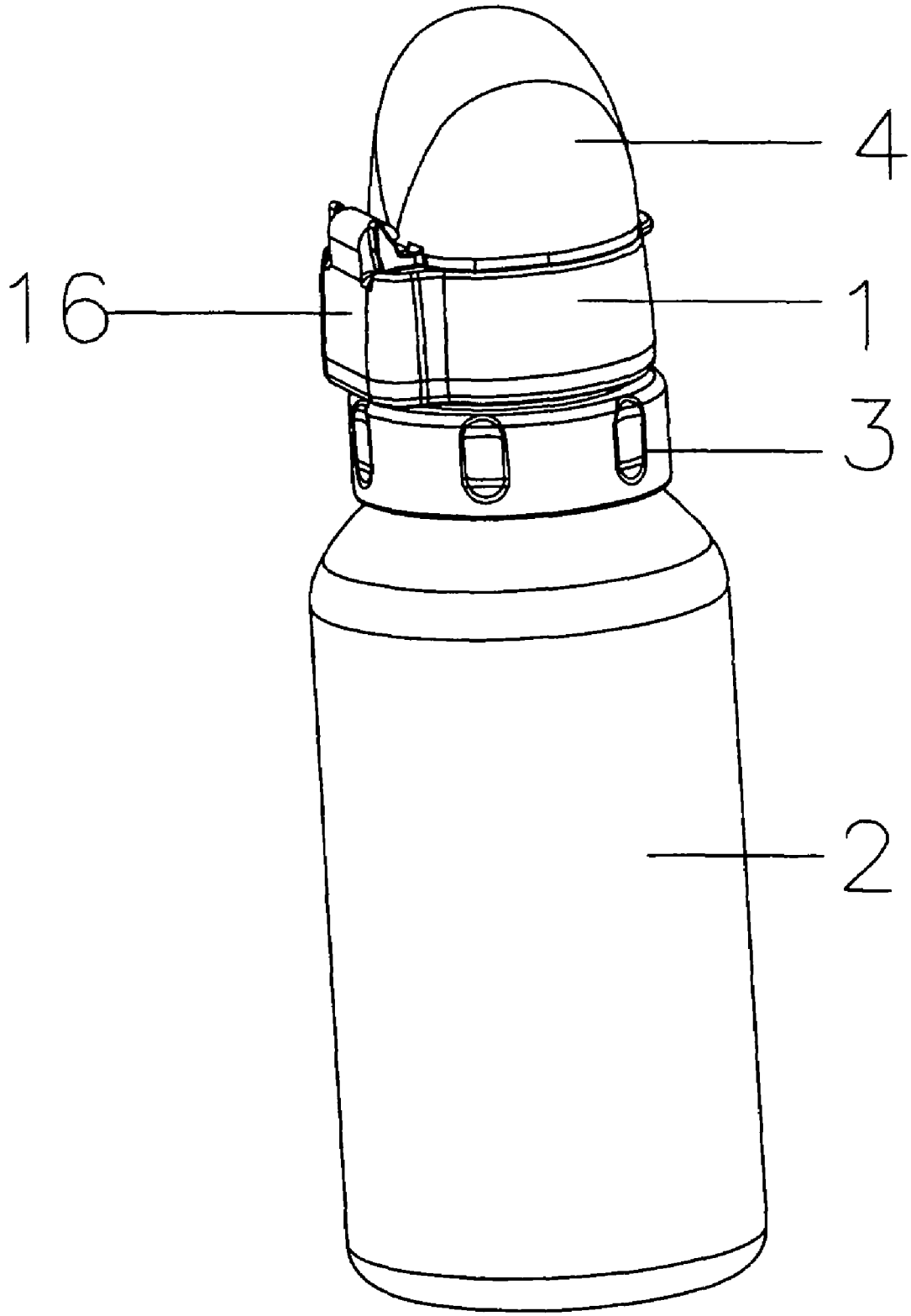
FIG. 4 is a schematic view of an adapter portion of the switch cap according to a second embodiment of the invention.
Figure 6:
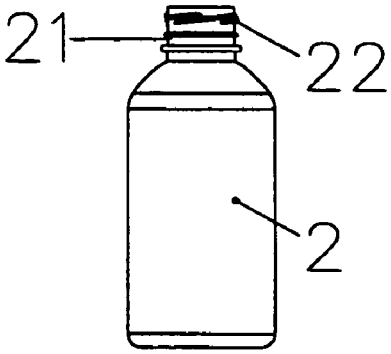
FIG. 6 is a schematic view of a drinking bottle of the invention.
Figure 8:
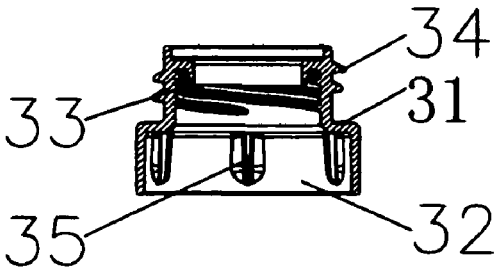
FIG. 8 is a cross-sectional view of the adapter portion of FIG. 7.
Figure 9:
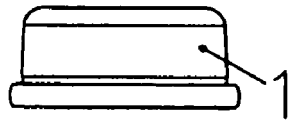
FIG. 9 is a perspective view of a rotatable cap according to a first embodiment of the invention.
Figure 10:
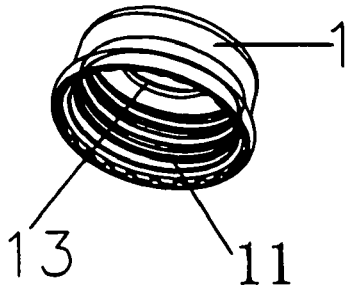
FIG. 10 is a perspective view of the rotatable cap of FIG. 9 according to another angle of view.
Figure 11:
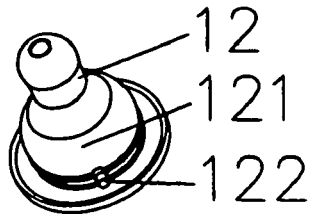
FIG. 11 is a perspective view of a nipple of the switch cap according to a first embodiment of the invention.
Figure 12:
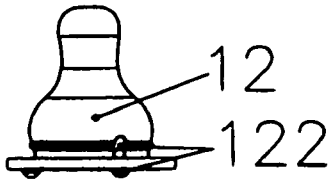
FIG. 12 is a perspective view of the nipple in FIG. 11 according to another angle of view.
Figure 13:
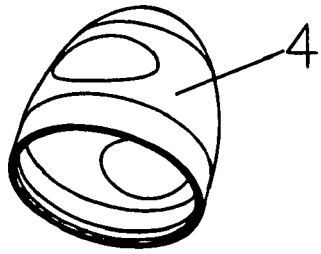
FIG. 13 is a schematic view of a cap cover of the switch cap according to a first embodiment of the invention.

Referring to FIG. 8, the cap body 32 has a top portion, a bottom portion which has a larger diameter than the top portion, and a plat shoulder 31 formed in the middle. Referring to FIG. 6, the drinking bottle 2 comprises an outside bottle screw thread 22 formed on the head portion 21 thereof. Referring to FIGS. 1 and 3, the outside bottle screw thread 22 is engaged with the inner screw thread 33. Referring to FIGS. 8-12, the rotatable cap 1 comprises an annular wall 13 arranged on a top thereof, and an inner cap screw thread 11 formed corresponding to the outside screw thread 34 and engaged with the outside screw thread 34. The annular wall 13 extends toward its center and is provided for receiving and positioning the nipple 12. Referring to FIGS. 11-12, a ventilate groove 122 is provided on a hemisphere bottom 121 of the nipple 12.

Referring to FIGS. 1, 4-8, 14-18, a switch cap for drinking bottle according to a second embodiment of the invention is illustrated as follows. The switch cap for drinking bottle comprises a rotatable cap 1, a nipple 12 received inside the rotatable cap 1, a cap cover 4 covering the rotatable cap 1, and an adapter portion 3. The rotatable cap 1 is rotatably connected with a circled head portion 21 of a drinking bottle 2 by the adapter portion 3. The adapter portion 3 comprises a cap body 32, an inner screw thread 33 provided on an inner wall of the cap body 32; an outside screw thread 34 provided on an outer wall of the cap body 32; and a plurality of slippery-proof concave grooves 35 provided on the outside circle of bottom of the cap body 32.

Figure 7:
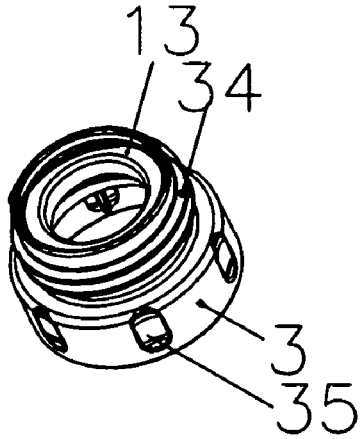
FIG. 7 is a perspective view of an adapter portion of the invention.
Figure 14:
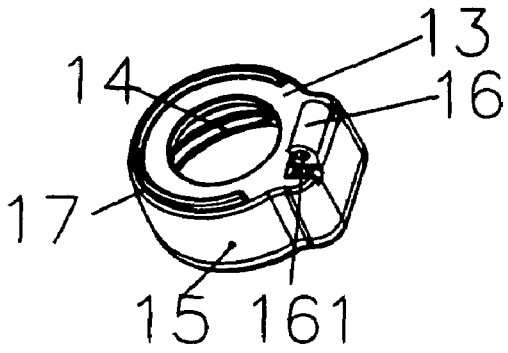
FIG. 14 is a perspective view of a rotatable cap according to a second embodiment of the invention.
Figure 16:
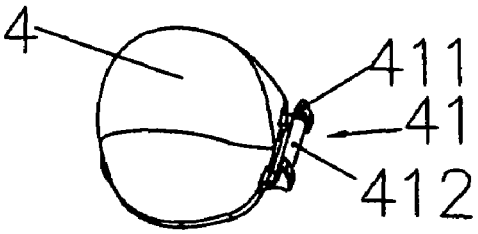
FIG. 16 is a perspective view of a cap cover of the switch cap according to a second embodiment of the invention.
Figure 17:
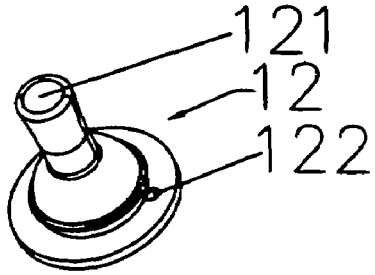
FIG. 17 is a perspective view of a nipple of the switch cap according to a second embodiment of the invention.

Referring to FIG. 8, the cap body 32 has a top portion, a bottom portion which has a larger diameter than the top portion, and a plat shoulder 31 formed in the middle. Referring to FIG. 6, the drinking bottle 2 comprises an outside bottle screw thread 22 formed on the head portion 21 thereof. Referring to FIGS. 1 and 8, the outside bottle screw thread 22 is engaged with the inner screw thread 33. Referring to FIGS. 7, 10, 14, the rotatable cap 1 comprises a cap body 15, an annular wall 13 arranged on a top thereof; an inner cap screw thread 14 formed corresponding to the outside screw thread 34 and engaged with the outside screw thread 34; a lock means 16 on a side of the cap body 15, and a non-close protrusion 17 on a top end of the cap body 15. Referring to FIGS. 14 and 17, the annular wall 13 extends toward its center and is provided for receiving and positioning the nipple 12. Referring to FIG. 16, a hinge means 41 is formed on the bottom of the cap cover 4, which comprises two symmetrical suspension arms 411 in its two ends and a rotation shaft 412 disposed between and integrally formed with the two suspension arms 411.

Figure 15:
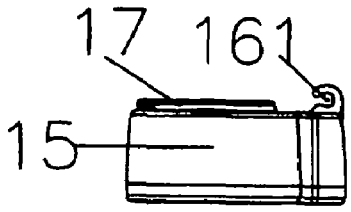
FIG. 15 is a perspective view of the rotatable cap in FIG. 14 according to another angle of view.

Referring to FIGS. 14-16, the lock means 16 of the cap body 15 comprises a detaining groove 161 in the middle thereof for detaining the rotation shaft 412. When the rotation shaft 412 is detained in the detaining groove 161, the suspension arms 411 of the hinge means 41 will just be locked on the two sides of the lock means 16. In fact, the lock means 16 is formed corresponding to the hinge means 41 of the cap cover 4 and engaged therewith. Referring to FIG. 14, the non-close protrusion 17 extends upwardly along an outer edge of the annular wall 13.

Figure 18:
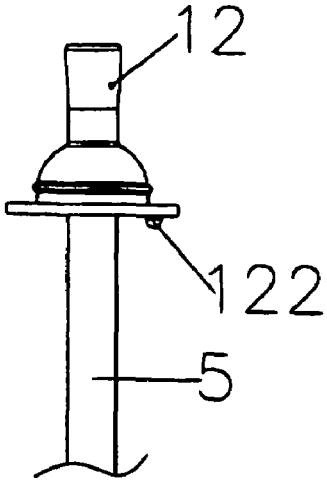
FIG. 18 is a schematic view of a nipple of FIG. 17 having a straw connected thereon.

Referring to FIG. 18, the nipple 12 comprises a sucking part 124 concave inwardly from a head of the nipple 12, and a positioning pipe 123. The positioning pipe 123 comprises a drinking straw 5 extending downwardly from the hemisphere bottom 121 of the nipple 12. Also, a ventilate groove 122 is provided on a hemisphere bottom 121 of the nipple 12.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A switch cap for drinking bottle, comprising:

a rotatable cap;

a nipple received inside the rotatable cap;

a cap cover covering the rotatable cap;

an adapter portion, wherein the rotatable cap is connected with a circled round mouth of the drinking bottle by the adapter portion;

a lock means including a transverse detaining groove on a side of the rotatable cap, a non-close protrusion on a top end of the rotatable cap, a hinge means formed on the bottom of the cap cover having a rotation shaft, a bulge formed at the side of the cap cover opposite to the detaining groove, the rotation shaft being disposed in the detaining groove, thereby the cap cover can be pivoted to open or close around the rotation shaft, when closed the cap cover engages with the non-close protrusion to lock the cap cover with the rotatable cap, the locked cap cover can be opened easily by using thumb to push the bulge; and the nipple having a receiving hole for receiving a drinking straw, which is inserted therein.

2. The switch cap as claimed in claim 1, wherein the adapter portion comprises a cap body, an inner screw thread provided on an inner wall of the cap body; an outside screw thread provided on an outer wall of the cap body; and a plurality of slippery-proof concave grooves provided on the outside wall at the bottom of the cap body; the cap body has a top portion, a bottom portion which has a larger diameter than the top portion, and a shoulder formed in the middle thereof.

3. The switch cap as claimed in claim 2, wherein the rotatable cap comprises an annular wall and an inner cap screw thread for engaging with an outside screw thread of the cap body of the adapter portion; the top of annular wall extends toward its center to form a ring plain for receiving the nipple.

4. The switch cap as claimed in claim 1, wherein the hinge means including two symmetrical suspension arms at two ends of the rotation shaft, the transverse detaining groove is located between the two suspension arms.

5. The switch cap as claimed in claim 1, wherein a ventilate groove is provided on a bottom of the nipple.

* * * * *